US007713671B2

(12) United States Patent
Tabata

(10) Patent No.: US 7,713,671 B2
(45) Date of Patent: May 11, 2010

(54) SEMISPHERICAL TONER HAVING PLURAL DENTS

(75) Inventor: Yukio Tabata, Mishima (JP)

(73) Assignee: Ricoh Company Limited, Tokyo (JP)

( * ) Notice: Subject to any disclaimer, the term of this patent is extended or adjusted under 35 U.S.C. 154(b) by 325 days.

(21) Appl. No.: 11/776,693

(22) Filed: Jul. 12, 2007

(65) Prior Publication Data

US 2008/0014523 A1 Jan. 17, 2008

(30) Foreign Application Priority Data

Jul. 12, 2006 (JP) ..... 2006-192216
Mar. 8, 2007 (JP) ..... 2007-058150

(51) Int. Cl.
*G03G 9/08* (2006.01)

(52) U.S. Cl. ..... 430/110.3; 430/137.1

(58) Field of Classification Search ..... 430/110.3, 430/137.1
See application file for complete search history.

(56) References Cited

U.S. PATENT DOCUMENTS 5,998,080 A * 12/1999 Ohno et al. ..... 430/45.54
6,020,103 A 2/2000 Tsubuko et al.
2004/0126692 A1* 7/2004 Yamanouchi et al. .... 430/110.3
2005/0026064 A1* 2/2005 Sugiura et al. ..... 430/109.4
2007/0020549 A1* 1/2007 Koyama et al. ..... 430/109.3

FOREIGN PATENT DOCUMENTS

JP 2002-287400 10/2002
JP 2003-058009 2/2003
JP 2004-226663 8/2004
JP 2005-037923 2/2005

* cited by examiner

*Primary Examiner*—John L Goodrow
(74) *Attorney, Agent, or Firm*—Oblon, Spivak, McClelland, Maier & Neustadt, L.L.P.

(57) ABSTRACT

A toner, which is semispherical and has plural dents on the surface, including a binder resin; and a pigment, wherein a circle circumscribing a circular profile of the toner provides an average envelopability (AE) of 10 to 10,000 particles thereof of from 74 to 84%, which is measured by the following formula:

$$AE(\%)=(AC-AD)/AC\times 100$$

wherein AC is an area of the circle and AD is a total sum of areas of the dents.

6 Claims, 3 Drawing Sheets

$$\text{ENVELOPABILITY} = \frac{\pi r^2 - (a+b+c+d+e)}{\pi r^2} \times 100$$

SEMISPHERICAL TONER HAVING PLURAL DENTS

BACKGROUND OF THE INVENTION

1. Field of the Invention

The present invention relates to a toner for use in electrophotography, and more particularly to the shape of a polymerized toner.

2. Discussion of the Background

A polymerized toner is prepared by solidifying a liquid droplet in a liquid emulsion or liquid suspension, i.e., oil in water, and alternatively dispersing and agglutinating particles and melting or softening the agglutinated particles to be associated in an aqueous medium. Formed through a liquid status, the particles tend to be spherical due to oil phase surface tension.

However, a spherical toner is more difficult than a pulverized toner to clean with a blade, which is currently a major cleaning device used in the industry, because the spherical toner is thought to have less edges than the pulverized toner. This problem is widely known in the electrophotographic field as disclosed in Japanese Published Unexamined Applications Nos. 2002-287400, 2003-058009, 2004-226663 and 2005-037923.

The more deformed the spherical toner, the more edges the toner has and the easier it is to clean. However, the more deformed, the more technically difficult and the lower the image quality. Therefore, the cleanable minimum deformity is an important subject in the electrophotographic field.

On the other hand, global environmental protection is more desired recently, and an energy-saving toner is required even in electrophotography.

A polymerized toner has a minimum fixable temperature of from 140 to 150° C. at lowest, and a fixable temperature width, i.e., hot offset temperature minus minimum fixable temperature, of from 50 to 60° C. at most.

Many toners prepared by non-pulverization methods using a dispersion or a solution of a resin or its precursor are known. For example, conventional polymerized toners prepared not only by a dispersion polymerization method disclosed in Japanese Published Unexamined Patent Application No. 63-297402 are just spherical, not semispherical having plural dents, and thus do not have sufficient cleanability. Japanese Published Unexamined Patent Application No. 2005-37923 discloses a toner having the shape of a rugby ball, which has sufficient cleanability, but produces images having quality worse than those produced by use of a spherical toner. In addition, to have the shape of a rugby ball, an extra process is necessitated.

Because of these reasons, a need exists for a toner having good cleanability and low-temperature fixability, and producing quality images.

SUMMARY OF THE INVENTION

Accordingly, one object of the present invention is to provide a toner having good cleanability and low-temperature fixability, and producing quality images.

This object and other objects of the present invention, either individually or collectively, have been satisfied by the discovery of a toner, which is semispherical and has plural dents on the surface, comprising:

a binder resin; and a pigment, wherein the toner has a circle circumscribing a circular profile thereof, having an average envelopability (AE) of 10 to 10,000 thereof of from 74 to 84%, which is measured by the following formula:

$$AE(\%)=(AC-AD)/AC\times 100$$

wherein AC is an area of the circle and AD is a total sum of areas of the dents.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a toner having good cleanability and low-temperature fixability, and producing quality images, which is semispherical and has plural dents on the surface, including a binder resin; and a pigment, wherein the toner has a circle circumscribing a circular profile thereof, having an average envelopability of from 74 to 84%; a minimum fixable temperature of from 110 to 140° C.; and a fixable temperature width of from 60 to 100° C., wherein the average envelopability (AE) of 10 to 10,000 of the toners is measured by the following formula:

$$AE(\%)=(AC-AD)/AC\times 100$$

wherein AC is an area of the circle and AD is a total sum of areas of the dents.

The methods of deforming (de-spheronizing) a spherical toner broadly include irregulating the profile of the toner and forming concavities and convexities on the surface thereof while basically maintaining the spherical profile thereof. The indications of the irregulated toners include average circularity and SF-1, both of which are considered good indications in this industry.

SF-2 is an indication of concavities and convexities, but is not a good indication of the cleanability. Japanese Published Unexamined Patent Application No. 2003-345055 discloses a method of measuring concavities and convexities on the surface of a toner with an AFM (atomic force microscope). However, this method does not measure the cleanability.

As mentioned above, a toner which is basically spherical and has specific concavities and convexities (specific deformation) satisfying cleanability requirements has not been available.

Figure 4:
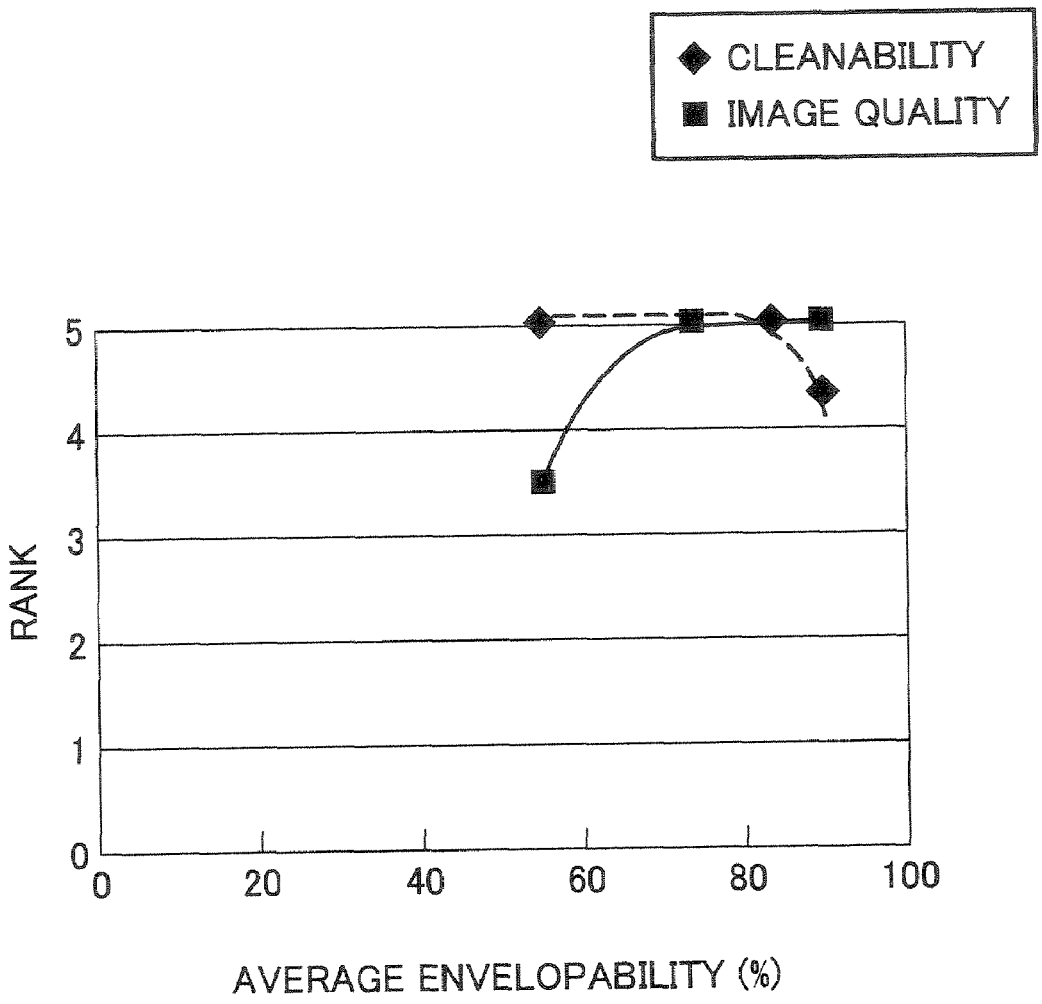
FIG. 4 is a diagram showing the relationships among the average envelopability and cleanability of the toner, and image quality produced thereby.

The toner of the present invention is a spherical toner having specific concavities. The toner has good cleanability as shown in FIG. 4. FIG. 4 is a diagram showing the relationships among the average envelopability and cleanability of the toner, and image quality produced thereby. The toner of the present invention maintains the advantages of its sphericity and has sufficient cleanability.

The toner of the present invention can be prepared by forming concavities when forming a spherical toner or a colored particulate resin having a small particle diameter before being agglutinated in a liquid by a non-pulverization method such as a polymerization method, a method of preparing a solid spherical particle from an emulsified liquid including crosslinkage in a liquid, and a method of agglutinating and solidifying a soft spherical particulate resin in a liquid. Methods of forming the concavities include, e.g., dispersing a dispersion or an emulsion including a colored particulate resin droplet (toner resin droplet or its precursor droplet) while partially or selectively adhering an inorganic or organic particulate material originally dispersed therein to the surface of the colored particulate resin droplet. The partial or selective adherence of the inorganic or organic particulate material is preferably controlled by controlling the dispersion strength (the rotation number of a disperser) or drying and solvent removal process after dispersed, but is not limited thereto.

Further, the partial or selective adherence of the inorganic or organic particulate material can be controlled by controlling the viscosity of the dispersion or emulsion, and the choice of a surfactant, a dispersant and a dispersion auxiliary agent and amounts thereof. These are preferably combined because a concavity is more easily formed in a place to which the inorganic or organic particulate material more adheres. In addition, an organic solvent or a gas may be removed by, e.g., aspirating with a vacuum pump or foaming. However, the toner of the present invention is not limited thereby, and has only to have the specific shape.

The toner of the present invention may be prepared by a suspension polymerization method, an emulsification agglutination method or a polymer agglutination method dissolving a polymer and re-agglutinating the polymer.

In one embodiment of the present invention, the toner is prepared by a method comprising:

dissolving or dispersing at least a polymer having a site reactable with a compound having an active hydrogen group, a compound having an active hydrogen group, a binder resin, a colorant, and a release agent in an organic solvent to prepare a solution or a dispersion;

dispersing the solution or dispersion in an aqueous medium;

removing the organic solvent from the solution or dispersion after or while subjecting the polymer having a site reactable with a compound having an active hydrogen group to a reaction with the compound having an active hydrogen group, to prepare a de-solvente solution or dispersion; and washing and drying the de-solvented solution or dispersion.

In a further embodiment of the present invention, the toner is prepared by a method comprising:

dissolving or dispersing at least a binder resin and a colorant in an organic solvent to prepare a toner constituent liquid;

emulsifying or dispersing the toner constituent liquid in an aqueous medium to prepare an emulsion or a dispersion;

removing the organic solvent from the emulsion or dispersion to prepare a de-solvented emulsion or dispersion; and washing and drying the de-solvented emulsion or dispersion.

In the following Example, a polymerized toner is prepared by an elongation method, however, a basically spherical toner having plural dents has the same properties regardless of the preparation methods.

The drying conditions can be changed to prepare toners having different deformities.

Hereinafter, the method of measuring the envelopability will be explained.

Figure 1:
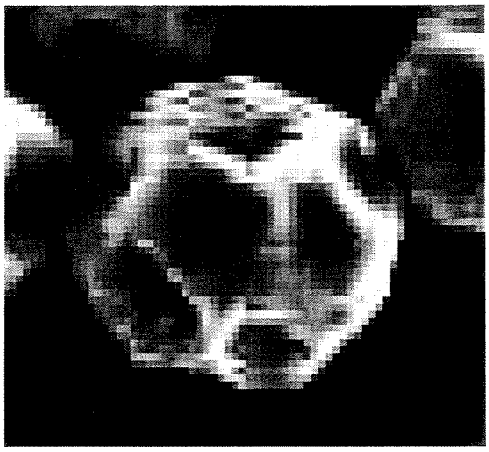
FIG. 1 is an electron microscope image of the toner of the present invention, the envelopability of which is measured.
Figure 2:
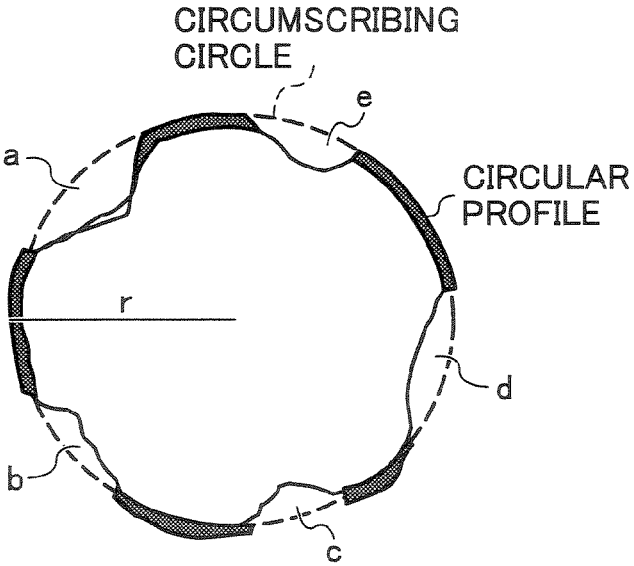
FIG. 2 is a schematic view illustrating how to measure the envelopability.
Figure 3A:
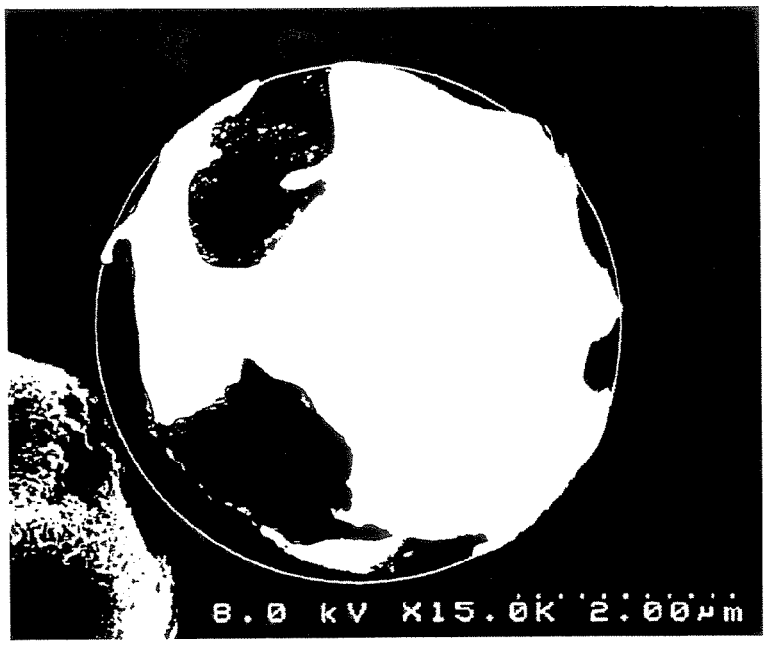
FIG. 3A is a profile of a two-dimensional image and a circle circumscribing the profile, which is the digitalized electron microscope image.
Figure 3B:
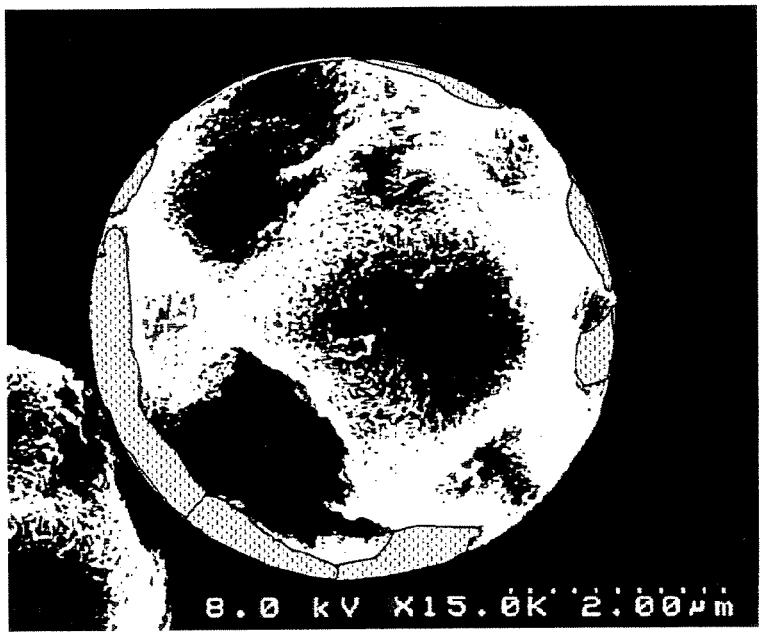
FIG. 3B is a schematic view illustrating how to specify the dent.

FIG. 1 is an electron microscope image of the toner of the present invention, the envelopability of which is measured. The toner is basically spherical and has plural dents. After the image is digitalized, as shown in FIG. 2, a circle circumscribing the profile (heavy line) thereof is drawn with a dotted line. A projected part from the circumscribing circle is exempt from measurement because of not frequently being formed and having little influence. FIG. 3A is a profile of a two-dimensional image and a circle circumscribing the profile, which is the digitalized electron microscope image. In FIG. 2, dents circumscribed by the circumscribing circle are specified, which are shaded regions in FIG. 3B. An area of the circumscribing circle and a total sum of areas of the dents are determined to determine the envelopability (E) of the present invention by the following formula:

$$E(\%)=(AC-AD)/AC\times 100$$

wherein AC is an area of the circle and AD is a total sum of areas of the dents.

An average envelopability of 10 to 10,000 of the toner particles is measured. When less than 10, the reliability is low. When more than 10,000, the cost performance is low. A hand calculation or automatic calculation with a computer may be used.

FIG. 4 is a diagram showing the relationships among the average envelopability and cleanability of the toner, and image quality produced thereby. A toner should preferably have an average envelopability not greater than 84% to have sufficient cleanability. The image quality is subjected to a sensory evaluation. A toner should preferably have an average envelopability not less than 74% to maintain the image quality at rank 5.

Therefore, the preferred average envelopability should be 74 to 84% to satisfy both of the cleanability and image quality requirements.

The cleanability, image quality, minimum fixable temperature and fixable temperature width will be explained.

Cleanability

After 100 A4 images are produced through imagio Neo450 from Ricoh Company, Ltd., a toner remaining on the photoreceptor after passing the cleaning process is transferred onto a blank paper with Scotch Tape from Sumitomo 3M, Ltd. The density of the toner is measured with Macbeth densitometer RD514 to compare with the density of the blank. The results are classified to the following 5 grades:

Rank 5: less than 0.01
Rank 4: from 0.01 to less than 0.02
Rank 3: from 0.02 to less than 0.03
Rank 2: from 0.03 to less than 0.04
Rank 1: not less than 0.04

Minimum Fixable Temperature and Fixable Temperature Width

Ricoh Paper Type 6200 is set in a copier MF-2200 from Ricoh Company. Ltd., wherein the fixer is modified to have a TEFLON roller to perform a fixing test. The fixing temperature is changed to determine a cold offset temperature at which the image is defectively fixed (minimum fixable temperature) and a hot offset temperature at which hot offset occurs (hot offset resistance temperature). The hot offset temperature minus the minimum fixable temperature equals the fixable temperature width The evaluation conditions of cold and hot offset resistance are as follows:

| | | |
|---|---|---|
| Cold Offset | Paper feeding linear speed: | 150 mm/sec |
| | Surface pressure: | 1.2 Kgf/cm$^2$ |
| | Nip width: | 3 mm |
| Hot offset | Paper feeding linear speed: | 50 mm/sec |
| | Surface pressure: | 2.0 Kgf/cm$^2$ |
| | Nip width: | 4.5 mm |

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 166 parts of methacrylate, 110 parts of butylacrylate and 1 part of persulfate ammonium are mixed in a reactor vessel including a stirrer and a thermometer, and the mixture is stirred for 15 min at 400 rpm to prepare a white emulsion therein. The white emulsion is heated to have a temperature of 75° C. and reacted for 5 hrs. Further, 30 parts of an aqueous solution of persulfate ammonium having a concentration of 1% are added thereto and the mixture is reacted at 75° C. for 5 hrs to prepare an aqueous dispersion a [particulate dispersion liquid 1] of a vinyl resin (a copolymer of a sodium salt of an adduct of styrene-methacrylate-butylacrylate-sulfuric ester with ethyleneoxide methacrylate).

The [particulate dispersion liquid 1] is measured by LA-920 to find a volume-average particle diameter thereof is 120 nm. A part of the [particulate dispersion liquid 1] is dried to isolate a resin component therefrom. The resin component has a glass transition temperature (Tg) of 42° C. and a weight-average molecular weight of 30,000.

90 parts of a polyester resin (formed of a derivative of a reaction product of succinic acid with a propylene oxide adduct of bisphenol A) having an acid value of 10 mg/KOH and a Tg of 52° C. from Sanyo Chemical Industries, Ltd. are kneaded with a two-roll mill having a surface temperature of 110° C. and a roll gap of 2 mm for 15 min, and 10 parts of a modified montmorillonite (Clayton HY from WILBUR-ELLIS COMPANY) are placed in the kneaded polyester resin. The mixture is further kneaded for 30 min and cooled to have a room temperature, and pulverized to have a diameter of 2 mm to prepare an [organic modified clay dispersion 1].

990 parts of water, 80 parts of the [particulate dispersion liquid 1], 40 parts of an aqueous solution of sodium dodecyldiphenyletherdisulfonate having a concentration of 48.5% (ELEMINOL MON-7 from Sanyo Chemical Industries, Ltd.), 90 parts of ethylacetate and 7.2 parts of a tetrafluoroethylene-perfluoroalkylvinylether copolymer having a number-average primary particle diameter of 0.15 μm are mixed and stirred to prepare a lacteous liquid an [aqueous phase 1].

The tetrafluoroethylene-perfluoroalkylvinylether copolymer adheres to the surface of an oil phase or a parent toner as a CCA (charge controlling agent).

229 parts of an adduct of bisphenol A with 2 moles of ethyleneoxide, 529 parts of an adduct of bisphenol A with 3 moles of propyleneoxide, 208 parts terephthalic acid, 46 parts of adipic acid and 2 parts of dibutyltinoxide are polycondensated in a reactor vessel including a cooling pipe, a stirrer and a nitrogen inlet pipe at a normal pressure and 230° C. for 8 hrs. Further, after the mixture is depressurized by 10 to 15 mm Hg and reacted for 5 hrs, 44 parts of trimellitic acid anhydride are added thereto and the mixture is reacted at a normal pressure and 180° C. for 3 hrs to prepare a [low-molecular-weight polyester 1].

The [low-molecular-weight polyester 1] has a number-average molecular weight of 2,500, a weight-average molecular weight of 6,700, a Tg of 43° C. and an acid value of 25.

463 parts of propyleneglycol, 657 parts terephthalic acid, 96 parts of trimellitic acid anhydride and 2 parts of titaniumtetrabutoxide are mixed and reacted in a reactor vessel including a cooling pipe, a stirrer and a nitrogen inlet pipe at a normal pressure and 230° C. for 8 hrs. Further, after the mixture is depressurized to 10 to 15 mm Hg, it is reacted for 5 hrs to prepare an [intermediate polyester 1].

The [intermediate polyester 1] has a weight-average molecular weight of 28,000, a Tg of 36° C. and an acid value of 0.5 and a hydroxyl value of 16.5.

Next, 250 parts of the [intermediate polyester 1], 18 parts of isophoronediisocyanate and 250 parts of ethylacetate are reacted in a reactor vessel including a cooling pipe, a stirrer and a nitrogen inlet pipe for 5 hrs at 100° C. to prepare a [prepolymer 1] The [prepolymer 1] includes an isocyanate in an amount of 0.61% by weight.

170 parts of isophoronediamine and 150 parts of methyl ethyl ketone are reacted at 50° C. for 5 hrs and a half in a reaction vessel including a stirrer and a thermometer to prepare a [ketimine compound 1]. The [ketimine compound 1] has an amine value of 418.

1,200 parts of water, 540 parts of carbon black PRINTEX 35 from Degussa A.G. having a DBP oil absorption of 42 ml/100 mg and a pH of 9.5, 1,200 parts of the [low-molecular-weight polyester 1] are mixed by a kneader upon application of pressure. After the mixture is kneaded by a two-roll mill having a surface temperature of 150° C. for 30 min, the mixture is rolled, cooled and pulverized by a pulverizer to prepare a [masterbatch 1].

378 parts of the [low-molecular-weight polyester 1], 110 parts of paraffin wax and 947 parts of ethylacetate are mixed in a reaction vessel including a stirrer and a thermometer. The mixture is heated to have a temperature of 80° C. while stirred. After the temperature of 80° C. is maintained for 5 hrs, the mixture is cooled to have a temperature of 30° C. in an hour. Then, 500 parts of the [master batch 1] and 500 parts of ethylacetate are added to the mixture and mixed for 1 hr to prepare a [material solution 1].

1,324 parts of the [material solution 1] and 110 parts of the [organic modified clay dispersion 1] are transferred into another vessel, and the organic modified clay, carbon black and wax therein are dispersed by a beads mill (Ultra Visco Mill from IMECS CO., LTD.) for 3 passes under the following conditions:

liquid feeding speed of 1 kg/hr; peripheral disc speed of 6 m/sec; and filling zirconia beads having diameter of 0.5 mm for 80% by volume.

Next, 1,324 parts of an ethyl acetate solution of the [low-molecular-weight polyester 1] having a concentration of 65% are added to the [material solution 1] and the mixture is stirred by the beads mill for 1 pass under the same conditions to prepare a [pigment and wax dispersion liquid 1] . The [pigment and wax dispersion liquid 1] has a solid content concentration of 50% when dispersed at 130° C. for 30 min.

749 parts of the [pigment and wax dispersion liquid 1], 115 parts of the [prepolymer 1], 2.9 parts of the [ketimine compound 1] and 76 parts of MEK-ST-UP having a solid content of 20% from Nissan Chemical Industries, Ltd. are mixed in a vessel by a TK-type homomixer from Tokushu Kika Kogyo Co., Ltd. at 5,000 rpm for 1 min. 1,200 parts of the [aqueous phase 1] are added to the mixture and mixed by the TK-type homomixer at 13,000 rpm for 20 min to prepare an [emulsified slurry 1].

The [emulsified slurry 1] is placed in a vessel including a stirrer and a thermometer. After a solvent is removed from the emulsified slurry 1 at 30° C. for 8 hrs, the slurry is aged at 45° C. for 4 hrs to prepare a [dispersion slurry 1].

The [dispersion slurry 1] has a volume-average particle diameter of 5.99 μm and a number-average particle diameter of 5.70 μm when measured with MULTIISIZER II.

After 100 parts of the [dispersion slurry 1] is filtered under reduced pressure, 100 parts of ion-exchanged water are added to the filtered cake and mixed by the TK-type homomixer at 12,000 rpm for 10 min, and the mixture is filtered.

Further, 100 parts of 10% hydrochloric acid are added to the filtered cake and mixed by the TK-type homomixer at 12,000 rpm for 10 min, and the mixture is filtered.

Further, 300 parts of ion-exchange water are added to the filtered cake and mixed by the TK-type homomixer at 12,000 rpm for 10 min, and the mixture is filtered. This operation is repeated again to prepare a [filtered cake 1].

The [filtered cake 1] is dried by an air drier at 45° C. for 48 hrs, and 15 parts thereof are added to 90 parts of water and dried by an air drier at 45° C. for 48 hrs and sieved by a mesh having an opening of 75 μm to prepare a [parent toner particle 1].

100 parts of the [parent toner particle 1], 0.7 parts of hydrophobic silica and 0.3 parts of hydrophobized titanium oxide are mixed by a HENSCHEL MIXER to prepare a toner 1.

The average envelopability of the toner 1 is measured.

5 parts of the toner 1 and 95 parts of Cu—Zn ferrite carrier coated with a silicone resin, having an average particle diameter of 50 μm are mixed to prepare a developer 1.

Images are produced by imagio Neo450 with the [developer 1] to evaluate the cleanability, image quality, minimum fixable temperature and fixable temperature as above.

Example 2

The procedure for preparation of the toner 1 in Example 1 is repeated to prepare a toner 2 except for removing a solvent from the emulsified slurry 1 at 30° C. for 6 hrs while increasing the vacuum in the vessel.

Comparative Example 1

The procedure for preparation of the toner 1 in Example 1 is repeated to prepare a comparative toner 1 except for removing a solvent from the emulsified slurry 1 at 30° C. for 10 hrs while decreasing the vacuum in the vessel.

Comparative Example 2

The procedure for preparation of the toner 1 in Example 1 is repeated to prepare a comparative toner 2 except for removing a solvent from the emulsified slurry 1 at 30° C. for 2 hrs while decreasing the vacuum in the vessel.

The envelopabilities of ten pieces of each toner are measured. The evaluation results are shown in Table 1.

TABLE 1

| | Toner No. | DT (hr) | AE (%) | CL | IQ | MFT (° C.) | FTW (° C.) |
|---|---|---|---|---|---|---|---|
| Example 1 | Toner 1 | 8 | 84 | 5 | 5 | 134 | 69 |
| Example 2 | Toner 2 | 6 | 74 | 5 | 5 | 134 | 69 |
| Comparative Example 1 | Comparative Toner 1 | 10 | 90 | 4.5 | 5 | 135 | 68 |
| Comparative Example 2 | Comparative Toner 2 | 2 | 55 | 5 | 3.5 | 133 | 70 |

DT: de-solvent time
AE: average envelopability
CL: cleanability
IQ: image quality
MFT: minimum fixable temperature
FTW: fixable temperature width From Table 1 and FIG. 4, toners 1 and 2 each having an average envelopability of from 74 to 84% satisfy cleanability and image quality, and each has a minimum fixable temperature of from 110 to 140° C. and a fixable temperature width of from 60 to 100° C.

Comparative Toner 1 having an average envelopability greater than that of Toner 1 (more spherical) has good image quality, but insufficient cleanability. Comparative Toner 2 having an average envelopability less than that of Toner 2 has good cleanability, but insufficient image quality. The minimum fixable temperature fixable temperature width do not depend on the deformity much, and each toner does not have much difference.

This application claims priority and contains subject matter related to Japanese Patent Applications Nos. 2006-192216 and 2007-058150, filed on Jul. 12, 2006, and Mar. 3, 2007, respectively, the entire contents of each of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

a binder resin; and a pigment, wherein the toner is semispherical and has plural dents on its surface, and wherein a circle circumscribing a circular profile thereof provides an average envelopability (AE) of 10 to 10,000 particles thereof of from 74 to 84%, which is measured by the following formula:

$$AE(\%)=(AC-AD)/AC\times 100$$

wherein AC is an area of the circle and AD is a total sum of areas of the dents;

wherein the toner has a minimum fixable temperature of from 110 to 140° C. and a fixable temperature width of from 60 to 100° C;

wherein the toner is prepared by a method comprising:

dissolving or dispersing at least a polymer having a site reactable with a compound having an active hydrogen group, a compound having an active hydrogen group, the binder resin, a colorant, and a release agent in an organic solvent to prepare a solution or a dispersion, wherein:

the polymer having a site reactable with a compound having an active hydrogen group is a polyester prepolymer comprising an isocyanate group;

the compound having an active hydrogen group is a ketimine compound;

the binder resin is a low-molecular weight polyester; and the release agent is a paraffin wax;

dispersing the solution or dispersion in an aqueous medium;

removing the organic solvent from the solution or dispersion after or while subjecting the polymer having a site reactable with a compound having an active hydrogen group to a reaction with the compound having an active hydrogen group, to prepare a de-solvented solution or dispersion; and washing and drying the de-solvented solution or dispersion.

2. The toner according to claim 1, wherein the removing the organic solvent step comprises removing the organic solvent at 30° C. for a time period of from 6 to 8 hours under vacuum.

3. The toner according to claim 1, wherein the method for forming the toner further comprises, after the removing the organic solvent step and before the washing and drying step, ageing the de-solvented solution or dispersion.

4. The toner according to claim 2, wherein the method for forming the toner further comprises, after the removing the organic solvent step and before the washing and drying step, ageing the de-solvented solution or dispersion.

5. The toner according to claim 3, wherein the ageing is performed for 4 hours at 45° C.

6. The toner according to claim 4, wherein the ageing is performed for 4 hours at 45° C.

* * * * *